US006481345B2

(12) United States Patent
Nishida et al.

(10) Patent No.: US 6,481,345 B2
(45) Date of Patent: Nov. 19, 2002

(54) SLIDE DRIVING METHOD FOR LINK TYPE TRANSFER PRESS AND LINK TYPE TRANSFER PRESS

(75) Inventors: Kenji Nishida, Komatsu (JP); Takashi Furuto, Komatsu (JP)

(73) Assignee: Komatsu Ltd., Tokyo (JP)

( * ) Notice: Subject to any disclaimer, the term of this patent is extended or adjusted under 35 U.S.C. 154(b) by 55 days.

(21) Appl. No.: 09/813,124

(22) Filed: Mar. 21, 2001

(65) Prior Publication Data

US 2001/0023644 A1 Sep. 27, 2001

(30) Foreign Application Priority Data

Mar. 21, 2000 (JP) ..... 2000-078401

(51) Int. Cl.[7] ..... B30B 13/00

(52) U.S. Cl. ..... 100/35; 72/451; 74/44; 100/282; 100/286; 100/264

(58) Field of Search ..... 72/408, 450, 451; 74/44, 393; 100/35, 154, 207, 257, 264, 286, 282, 299, 273

(56) References Cited

U.S. PATENT DOCUMENTS 3,869,927 A * 3/1975 Lose et al. ..... 74/44
5,852,970 A * 12/1998 Bornhorst et al. ..... 100/282 X
6,405,576 B1 * 6/2002 Endo et al. ..... 72/451

* cited by examiner

*Primary Examiner*—W. Donald Bray
(74) *Attorney, Agent, or Firm*—Armstrong, Westerman & Hattori, LLP.

(57) ABSTRACT

A link type transfer press is driven by continuously dwelling the slide in the vicinity of the top dead center thereof with the use of a link mechanism. With this arrangement, a motion index angle of a feeder can be taken by a large degree even though the time required for one cycle of the slide is shortened, and accordingly, the transfer time of the feeder can be set to be substantially longer so that the feed can be fed without interference with the slide. Thus, the entire pressing time can be reduced, thereby enhancing the productivity.

6 Claims, 7 Drawing Sheets

SLIDE DRIVING METHOD FOR LINK TYPE TRANSFER PRESS AND LINK TYPE TRANSFER PRESS

BACKGROUND OF INVENTION

1. Field of the Invention

The present invention relates to a slide driving method for a link type transfer press which is used for automatically and continuously carrying out a process beginning with insertion of a workpiece and ending with completion of processing of the workpiece within a single press, and also relates to a link type transfer machine.

2. Description of Related Art

Among several press machines, there has been well-known a transfer press which can consistently carry out a process for products, which requires several process steps beginning with insertion of a workpiece and ending with completion of processing of the workpiece in a single press.

In a transfer press, blanks (workpieces) separated from one another are transferred successively into dies in a next process station by means of a pair of feed bars constituting a feeder, and fingers attached thereto, and a slide to which the dies are attached is moved up and down in association with this transfer operation so as to carry out pressing operation.

In the so-called link type transfer press, the elevation of the slide is carried out with the use of a link mechanism.

In a conventional transfer press, the slide is moved down from the top dead center in a fast forward mode until an upper die abuts against a workpiece, and after molding of the workpiece, the slide is moved up to the top dead center in a fast forward mode.

In the above-mentioned conventional link type transfer machine suffers from hindrances to the enhancement of productivity, one of which is a limitation to the feed speed of the feeder, which disable the stroke frequency per minute (SPM) from being increased. In other words, if the time required for one cycle is shortened, a required feed time of the feeder cannot be ensured.

That is, as shown in FIG. 8, the conventional slide motion curve is such that the slide descends from the top dead center A in a fast forward mode, and after completion of press molding at the bottom dead center B, the slider rapidly ascends therefrom to the top dead center A in a fast forward mode. During one cycle of the slide from the top dead center to the dead center, and then to the top dead center, a range (time) in which the feeder can be transferred without interference with the slide is exhibited by the time (T1+T1) from the starting point O of the cycle to a position C to which the slider descends from the top dead center A by a predetermined distance H on both sides of the starting point O.

Meanwhile, the transfer speed of the feeder is determined by a relationship of inertial moment and the like, and as a result, a required time t1 for the cycle from the top dead center A to the top dead center A is inevitably determined.

It is noted, referring to FIG. 8, that the required time for one cycle with respect to the starting point O is taken along the abscissa, and the slide stroke is taken along the ordinate. Although the angle is usually taken along the abscissa, this exhibition can hardly be understood, and accordingly, the cycle time is taken therealong for the sake of convenience in understanding.

In the above-mentioned slide motion, it may be considered that a time t2 required for one cycle is simply shortened to a value smaller than the above-mentioned time ti, as exhibited by a phantom line (two-dot broken line) in FIG. 8, and as a result, the time required for the entire process is shortened in order to enhance the productivity.

However, in the conventional slide motion, should the time required for one cycle be simply shortened from the time t1 to the time t2, would cause such a problem that a possible transfer range of the feeder in the slide motion, that is, the time T2+T2 which corresponds to a range from the starting point O of the cycle to the position C to which the slide descends from the top dead center A by the predetermined distance H, become shorter than the above-mentioned time T1+T1.

Meanwhile, the transfer time of the feeder requires a certain predetermined time in view of the inertial moment of the feeder and the like, and accordingly, in the normal slide motion, the transfer motion of the feeder is designed in accordance with the critical value. Thus, if the transfer time of the feeder is shortened, the transfer of the feeder becomes insufficient, and accordingly, the feeder interferes with the slide so as to raise such a problem that a predetermined pressing process can not be made.

SUMMARY OF THE INVENTION

An object of the present invention is to provide a slide driving method in a link type transfer press and a link type transfer press, which can enhance the SPM of a slide while the transfer time of the feeder is ensured so as to enhance the productivity.

To the end, according to the present invention, there is provided a slide driving method for a link type transfer press which is always coupled to a drive source so as to move a slide up and down through the intermediary of a slide drive mechanism, characterized in that the slide is driven by continuously dwelling the slide in the vicinity of the dead center thereof without stopping a press.

In this arrangement of the present invention, since the slider dwells in the vicinity of the top dead center thereof for a predetermined time, the motion index angle (transfer time) of the feeder which is dominant in the entire cycle can be taken by a large degree so as to enable the transfer time t2 of the feeder to be substantially longer even thought a time required for one cycle of the slide is shortened. As a result, the SMP of the slider can be enhanced while the transfer time of the feeder can be ensured so as to shorten the entire press time, thereby it is possible to aim at enhancing the productivity.

In the present invention, "dwell" means that the slider stops or stays in a constant condition. More specifically, the slide substantially uniformly holds its height for a predetermined time in the vicinity of the top dead center even though the press is operated. As to the dwell condition, although there may be considered along the top dead center a wavy condition, a horizontal condition, a certain wavy swelling condition or the like, there may be included a right shoulder descent condition since it is sufficient to stop or stay in the vicinity of the top dead center.

The characteristic feature of the present invention is to provide the link type transfer press with a dwell mechanism for causing the slide to continuously dwell in the vicinity of the top dead center without stopping the press.

As to the dwell generating mechanism, an existing link mechanism, a link mechanism using an eccentric drum or the like may be used, and further, a cam mechanism having a profile in accordance with a dwell may also be used. However, a link mechanism is preferably used since it is structurally simple and can be simply manufacture.

In this arrangement, since the slide can continuously dwell in the vicinity of the top dead center by means of the dwell generating mechanism, the moving time of the feeder can be made to be longer even though the time required for one cycle is shortened, and accordingly, the feeder can be fed without interfering with the slider during this period. As a result, the SMP of the slide can be enhanced so as to shorten the press time in its entirety. Thereby, it is possible to enhance the productivity.

DETAILED DESCRIPTION OF THE PREFERRED EMBODIMENTS

Explanation will be hereinbelow made of an embodiment of the present invention with reference to the accompanying drawings.

In this embodiment, by allowing a slide to which dies are mounted to dwell (stop or stay in a substantially constant condition) in the vicinity of the top dead center for predetermined time in a transfer press, the motion index angle of a feeder is set to be larger so as to ensure the transfer time of the feeder, while the SPM (strokes per minute) of the slide is increased.

Further, this embodiment is applied to a device which using a two-dimensional feed bars which take motions for clamping, advancing, unclamping and returning.

Figure 1:
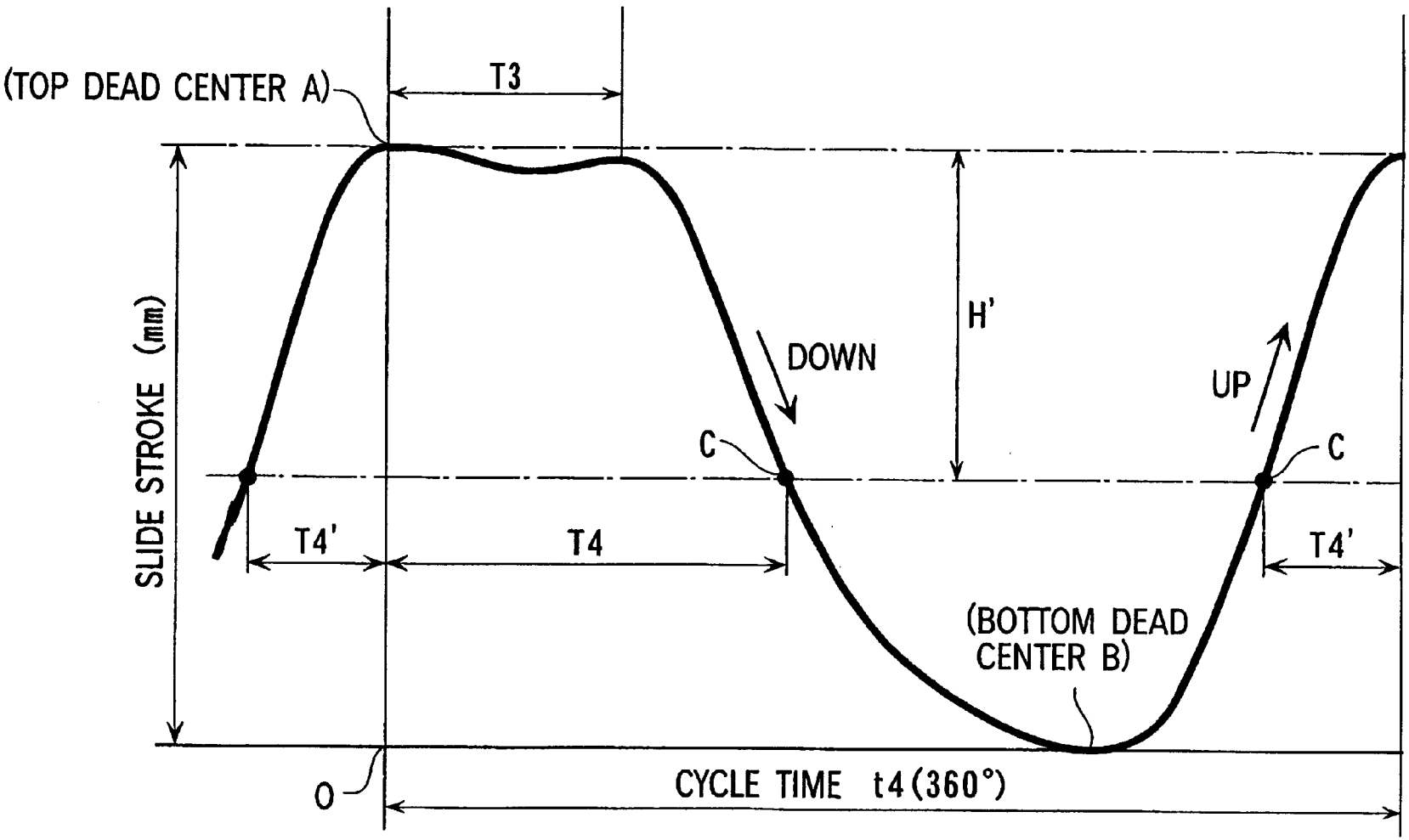
FIG. 1 is a view which shows a slide motion in a link-type transfer press in an embodiment of the present invention.

As shown in FIG. 1, a slide motion of the embodiment includes a dwell range T3 in which the slide advances in a wavy pattern from the starting point (an angle of zero) 0 of a cycle, along a line which is horizontally extended from the top dead center A.

Further, an allowable feeder transfer range, that is, the time T4+T4 is substantially equal to the above-mentioned allowable feeder transfer range, that is, the time T1+T1, and the time t4 required for one cycle of the slide becomes shorter than time ti required for the cycle of the conventional one.

It is noted that the heightwise length of the wave in the dwell range, that is, the time T3, is set to, for example, about 20 to 30 mm, and the height of a point C to which the slide descent from the top dead center A by a predetermined length H is set to, for example, about 50 to 60% of the slide stroke.

FIGS. 2 to 5 show an embodiment of a link mechanism 10 serving as a dwell generating mechanism for generating the above-mentioned dwell.

Referring to these figures, an eccentric drum 12 is coupled at one end to the center of a main shaft (main gear) 11, and is also coupled at the other end with one end of a starting link 13 through the intermediary of coupling point b.

A corner part 14A of a toggle lever 14 exhibited by a triangular shape is coupled to the other end of the staring link 13 through the intermediary of a coupling point c, another comer part 14B of the toggle lever 14 is swingably supported by means of a coupling pin d, and the remainder corner part 14C thereof is coupled thereto with one end of a push link 15 through the intermediary of coupling point e. The other end of the push link 15 is coupled to one corner part 16A of a toggle link 16 exhibited by a triangular shape through the intermediary of a coupling point f, another corner part 16B of the toggle link 16 is swingably supported to the center a of the main shaft 11, and the remainder comer part 16C thereof is coupled thereto with the proximal end of a connection rod 17. Further, a slide 18 is mounted to the front end of the connecting rod 17.

The eccentric drum 12 can be rotated around the center a, as a base point, of the main shaft 11 in association with the rotation of the main shaft 11, and one end of the staring link 13 is rotated, being pulled thereby, on a rotating locus M of the coupling point b in the eccentric drum 12. At this time, the other end of the starting link 13 is rotated on the rotating locus O of the coupling point c.

The corner part 14A of the toggle lever 14 is reciprocated being pulled by the starting link 13, on the rotating locus O of the coupling point c between a predetermined position and a position in the vicinity of a position where it is tangent to the rotating locus M, and accordingly, the toggle lever 14 can be swung. Further, in association with the swing motion of the toggle lever 14, one end of the push link 1.5 travels on the rotating locus P of the coupling point e while the end thereof travels on the rotating locus N of the coupling point f over a predetermined range, both ends thereof being swung while their positions are changed.

In association with the swing motion of the push link 15, the corner part 16A of the toggle link 16 travels on the rotating locus N of the coupling point f over a predetermined range, and accordingly the toggle link 16 can be swung around the center of the main shaft 11 as a base point.

Further, in association with the swing motion of the toggle link 16, the connecting rod 17 or the slide 18 slides in the vertical direction (the direction of the arrow S).

Thus, the above-mentioned link mechanism 10 includes the eccentric drum 12, the staring link 13, the toggle lever 14, the push link 15, the toggle link 16 and the connecting rod 17.

Next, the relationship between the link mechanism 10 shown in FIGS. 2 to 5 and the slide motion shown in FIG. 1 will be described.

Figure 2:
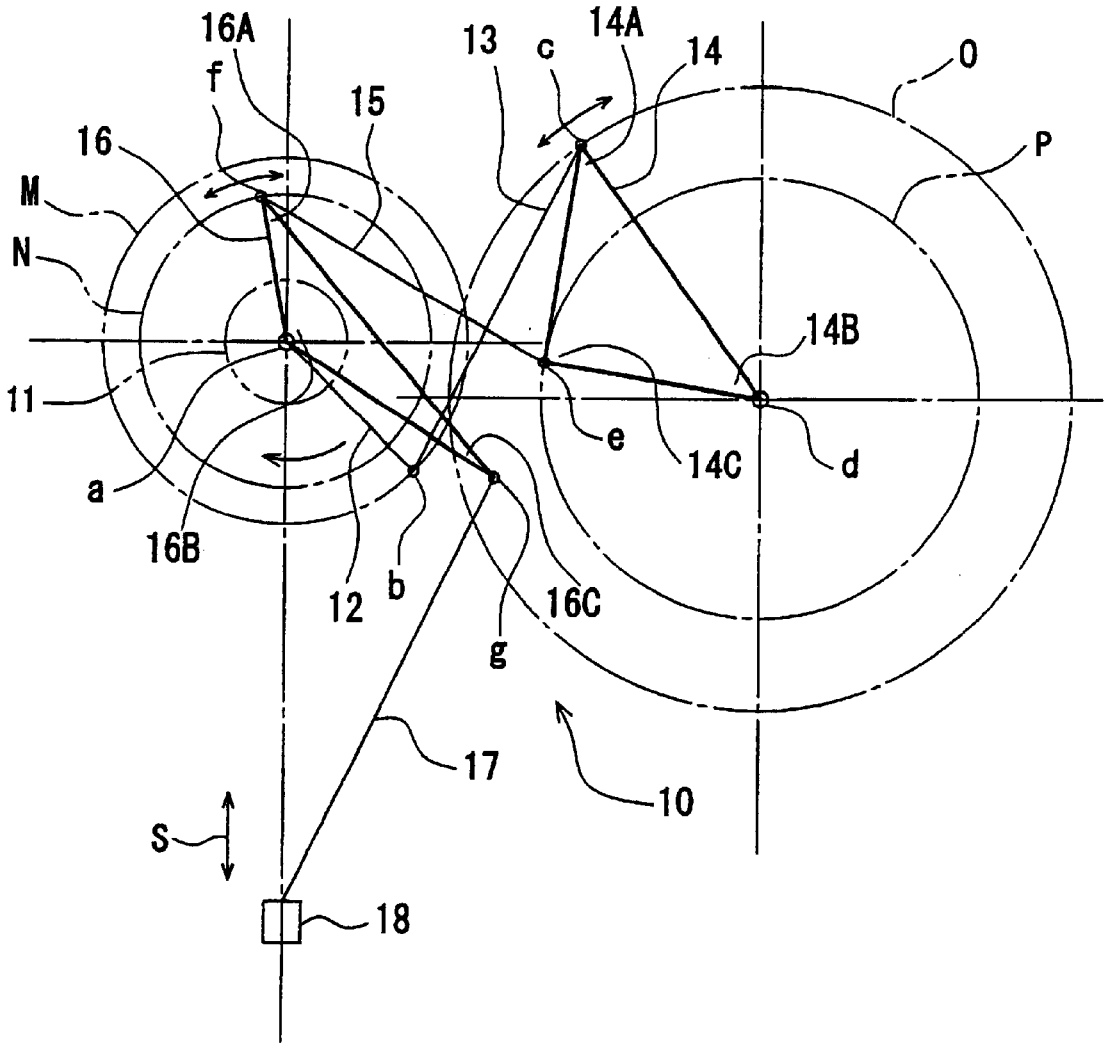
FIG. 2 is a view which shows a first angle of a link mechanism used in the link type transfer press in the embodiment of the present invention.

In a condition shown in FIG. 2, the slide 18 is located in the vicinity of the top dead center A, and the main shaft 11 is rotated by an angle of about 80 deg. until the slide 18 exceeds the dwell range T3.

Figure 3:
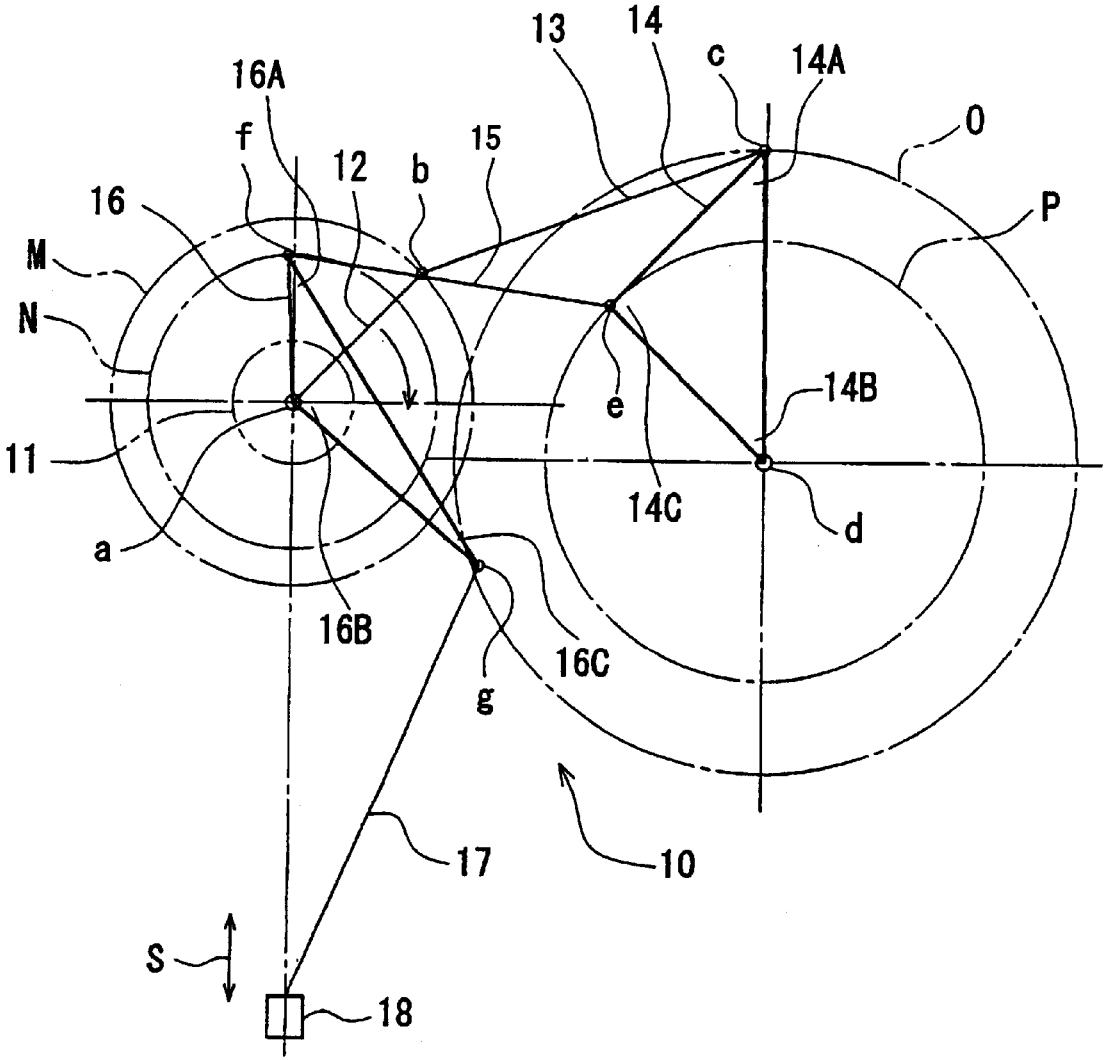
FIG. 3 is a view which shows a second angle of the link mechanism used in the ling type transfer press in the embodiment of the present invention.

In a condition shown in FIG. 3, the main shaft 11 has been rotated by a predetermined angle so that a predetermined time elapses, and the slide 18 gradually descends, exceeding the dwell range L3.

Figure 4:
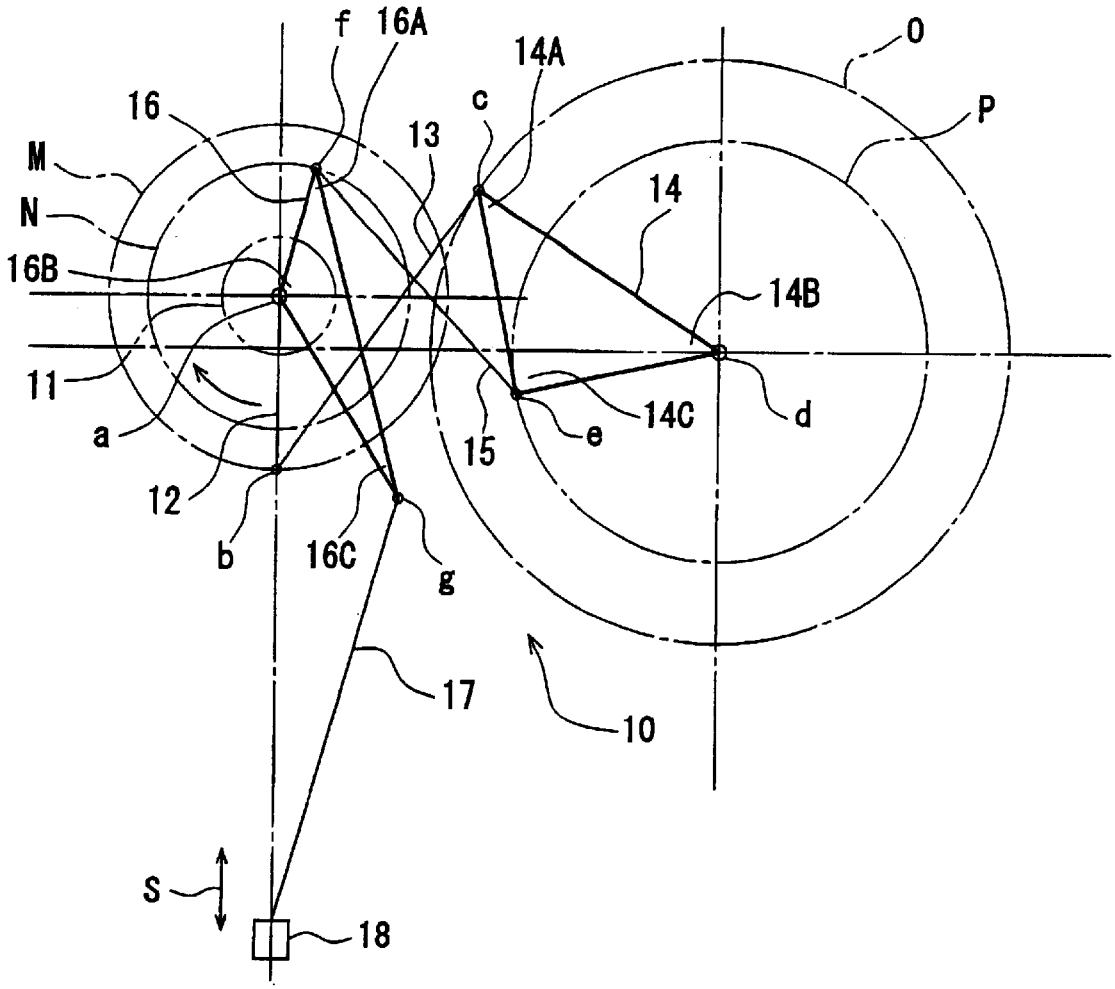
FIG. 4 is a view which shows a third angle of the link mechanism used in the ling type transfer press in the embodiment of the present invention.

In a condition shown in FIG. 4, the slide 18 further descend to a position just before the bottom dead center B, and accordingly, the main shaft 11 has been rotated by about 200 turns.

Figure 5:
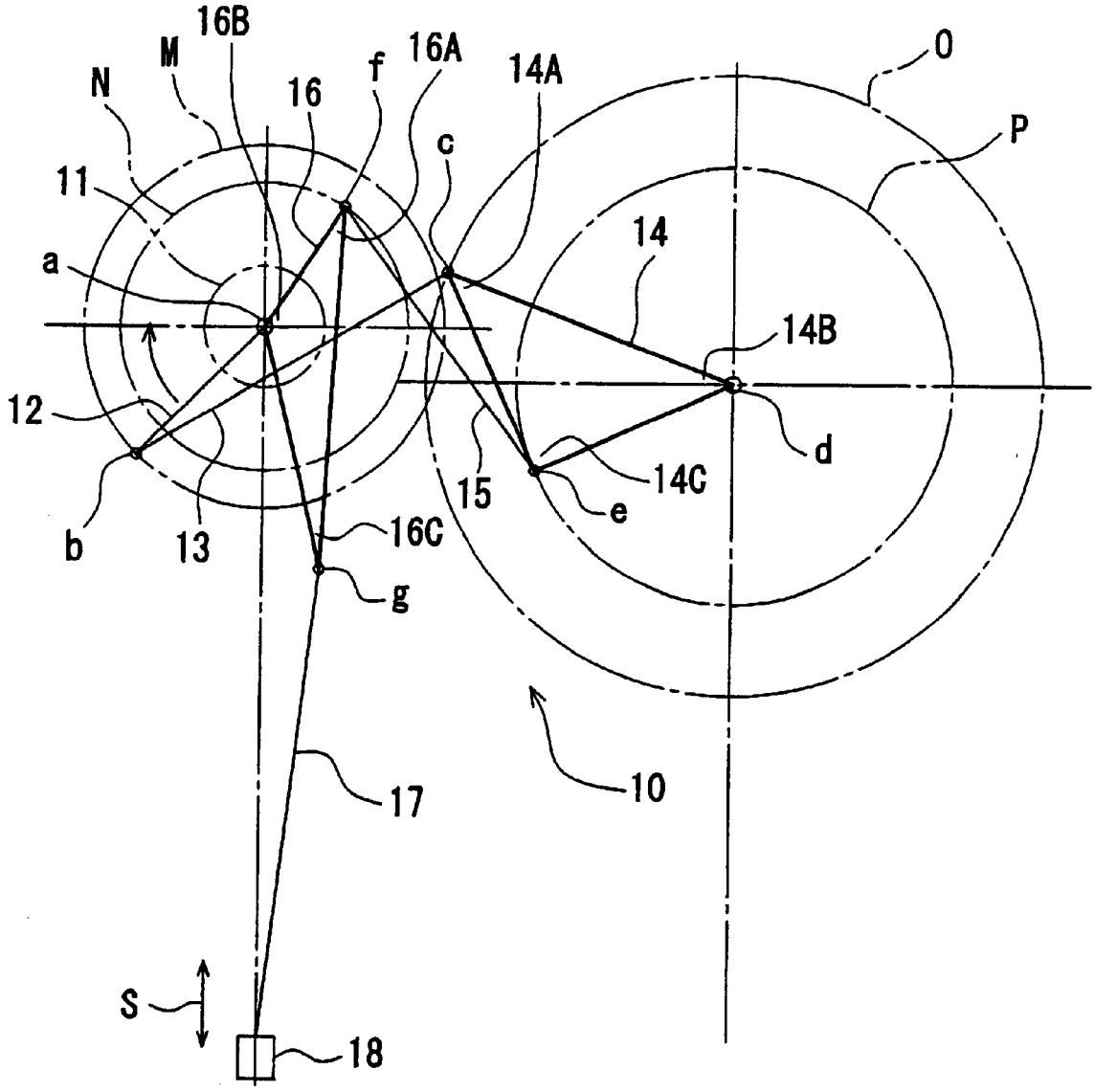
FIG. 5 is a view which shows a fourth angle of the link mechanism used in the ling type transfer press in the embodiment of the present invention.

Referring to FIG. 5 which shows such a condition that the slide 18 is located at the bottom dead center B, that is, the pressing has been carried out, and the main shaft 11 has been rotated by about 250 turns.

After the completion of the pressing, the main shaft 11 is further rotated so that the slide 18 rapidly ascends by means of a fast return mechanism, and is returned to the original position as shown in FIG. 2.

In order to cause (effect) a dwell in this embodiment, the lengths of the link members, that is, the eccentric drums 12 to the connecting rods 17 which are components of the link mechanism and which are denoted by a series of numbers, are adjusted, and accordingly, for example, the swing time of the toggle lever 14 is held for a long time.

Next, explanation will be made of the operation of this embodiment.

During pressing, when the slide 18 is located in the vicinity of the top dead center A, the slide 18 is dwelled over the dwell range of the time T3 under action of the link mechanism 10. During this period, the press is not stopped and accordingly, the main shaft 11 is on rotation. After the slide 18 exceeds a dwell range of the time T3, it starts descending so as to cause completion of the transfer of the feeder in an allowable feeder transfer range at the position C which is below the top dead center A by a predetermined heightwise length H, that is, within the range of the time T4+T4 in which the slide and the feeder do not interfere with each other. The slide 18 further descends, and accordingly, a predetermined pressing operation is started from a position in the vicinity of the bottom dead center B, and the pressing operation is completed when slide 18 reaches the bottom dead center B from which the slide 18 rapidly ascends by means of the return mechanism in the link mechanism 10. Thus, one cycle of the operation is completed. With the repetitions of these motions, a predetermined pressing process is competed.

Figure 6A:
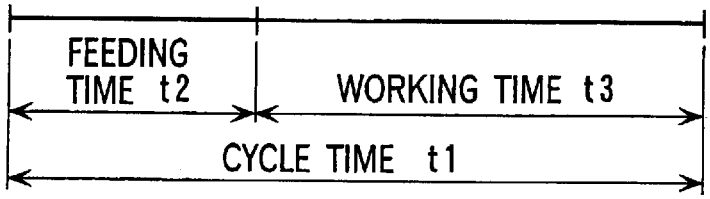
FIGS. 6(A) and 6(B) are views which show comparison of the present embodiment of the present invention with a conventional arrangement.
Figure 6B:
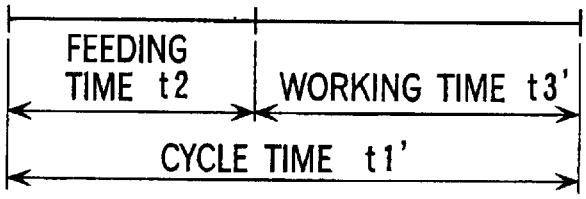

This embodiment as mentioned above, can exhibit the following technical effects and advantages:

(1) Since the slide 18 dwells over the dwell range of the time T3 in the vicinity of the top dead center A, if, for example, the time t1 required for one cycle of the slide 18 is set to be shorter than the conventional time t1, the rate dominant in the full range can be taken by a large degree, as shown in FIG. 6(B) even thought the feeder transfer time t2 is unchanged, and accordingly, the feeder transfer time t2 can be ensured while the feeder can be transferred without interference with the slide 18. As a result, the processing time t3 can be set to be shorter than the conventional processing time t3, and as well, the time required for one cycle of the slide can be also shortened, that is, the SPM can be enhanced. Thus, the entire pressing time can be shortened, thereby it is possible to aim at enhancing the productivity.

(2) The range, pattern and the like of dwell can be simply changed by adjusting the lengths of the link members including the eccentric drum 12 to the connecting rod 17 which are components of the link mechanism 10, and accordingly, a slide motion containing an optimum dwell can be simply formulated in accordance with a configuration of a press molding.

It is noted that the present invention should not be limited to the above-mentioned embodiments, but can include various variant forms of this embodiment within the technical scope of the present invention.

Figure 7A:
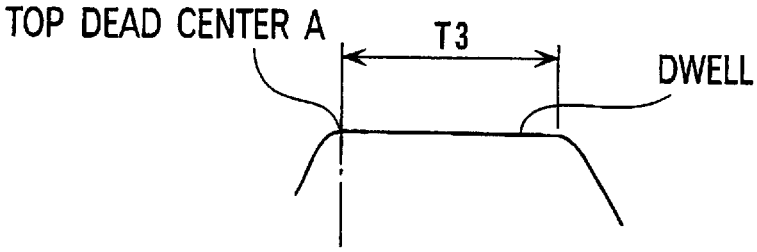
FIGS. 7(A), 7(B) and 7(C) which are views illustrating examples of a dwell in variant forms of the present invention, respectively.
Figure 7B:
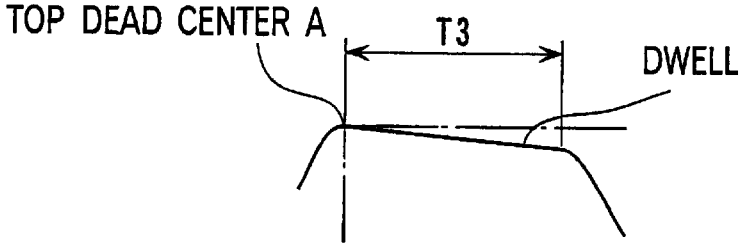
Figure 7C:
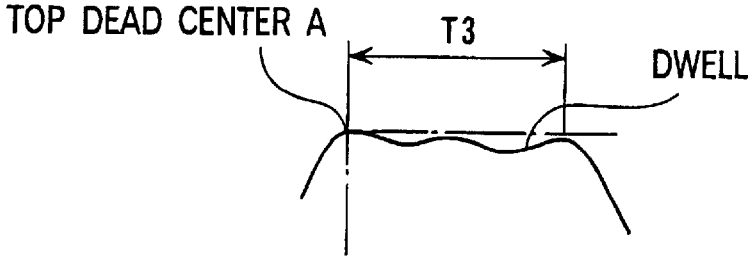
Figure 8:
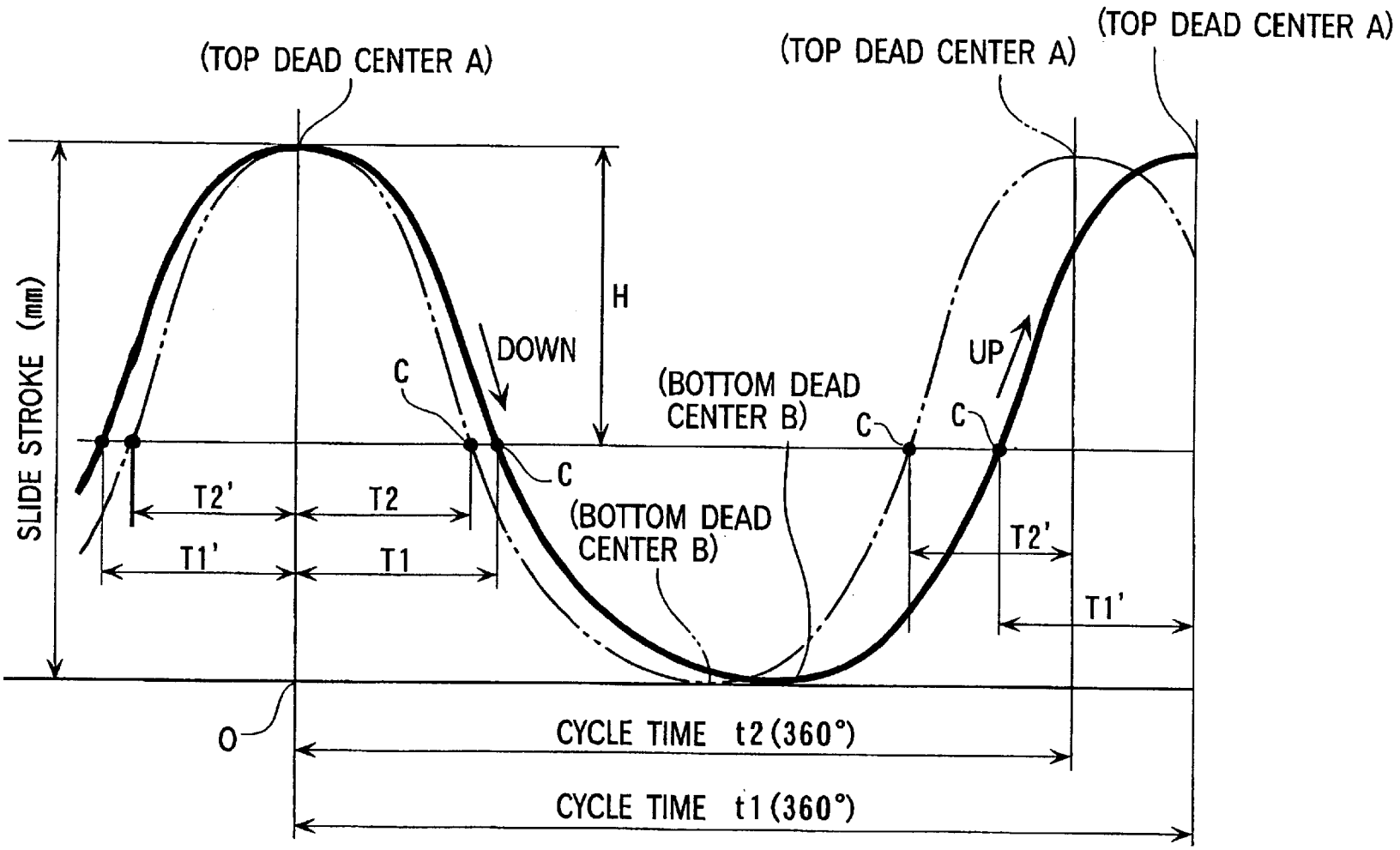
FIG. 8 PRIOR ART
FIG. 8 is a view illustrating a slide motion in a conventional link type transfer press.

For example, the pattern of the dwell is set in a tubular condition (such a condition that the slide slightly descends in the intermediate while it is held at a substantially constant position. Refer to FIG. 1) in the above-mentioned embodiment, but, in addition, there may be used a rectilinear dwell along the top dead center A as shown in FIG. 7(A), a dwell having a pattern which is present in part at the top dead center A and drops in a right shoulder lowering configuration, as shown in FIG. 7(B), and a certain wavy swelling pattern as shown in FIG. 7(C). That is, it may be sufficient that the slide dwells around the top dead center A.

Further, the dwell range of the time T3 is set in a range from 20 to 30 mm while the heightwise distance by which the slide descends from the top dead center A down to the position C by the predetermined value H, is set to be about 50 to 60% of the slide stroke in the above-mentioned embodiment. However, these values should not be limited, but may be suitably changed in accordance with any of various properties and materials of presses.

Further, as the dwell generating mechanism, an existing link mechanism or a mechanism using an eccentric drum and the like can be used, and further, a cam mechanism or the like having a profile in accordance with a dwell may be used.

Further, the feeder is a two-dimensional device in the above-mentioned embodiment, but the present invention can also be used for a feeder of a three-dimensional device. In this case, a lift-down motion is added during motions of clamping, advancing, unclamping and returning so as to obtain motions of clamping, lifting, advancing, moving down, unclamping and retuning.

Further, the workpiece is transferred by the fingers attached to the feeder bar in the above-mentioned embodiment, but the workpiece may be transferred by a cross-bar which is attached to the feed bar and which is attached thereto with a sucking means such as a vacuum cup.

What is claimed is:

1. A slide driving method for a link type transfer press which is always coupled to a drive source so as to move up and down a slide through a slide drive mechanism, wherein the slide is driven by continuously dwelling the slide in the vicinity of the top dead center thereof without stopping the press.

2. The slide driving method for a link type transfer press according to claim 1, wherein the dwell traces a wavy locus which is held at a substantially constant position along the top dead center but slightly descends at an intermediate portion thereof.

3. The slide driving method for a link type transfer press according to claim 1, wherein the dwell traces a rectilinear locus which is held substantially at a substantially constant position along the top dead center.

4. The slide driving method for a link type transfer press according to claim 1, wherein the dwell traces a locus which is in part located at the top dead center, and thereafter moderately descends so as to obtain a right shoulder lowering pattern.

5. A link type transfer press, comprising a dwell generating mechanism for dwelling a slide in the vicinity of the top dead center thereof without stopping the press.

6. The link type transfer press according to claim 5, wherein said dwell generating mechanism is a link mechanism.

* * * * *